US006107756A

United States Patent [19]

Parra

[11] Patent Number: 6,107,756

[45] **Date of Patent: *Aug. 22, 2000**

[54] LOW-VOLTAGE NON-THERMIONIC BALLAST-FREE ENERGY-EFFICIENT GAS-DISCHARGE LANDSCAPE LIGHTING SYSTEM AND METHOD USING HIGH-FREQUENCY SQUARE WAVE AC DRIVER CIRCUITS

[76] Inventor: Jorge M. Parra, 8210 Sycamore Dr., New Port Richey, Fla. 34654

[ * ] Notice: This patent issued on a continued prosecution application filed under 37 CFR 1.53(d), and is subject to the twenty year patent term provisions of 35 U.S.C. 154(a)(2).

[21] Appl. No.: 09/039,224

[22] Filed: Mar. 16, 1998

Related U.S. Application Data

[63] Continuation-in-part of application No. 08/964,824, Nov. 5, 1997.

[60] Provisional application No. 60/053,796, Jul. 25, 1997.

[51] Int. Cl.[7] ..... H05B 37/02

[52] U.S. Cl. ..... 315/324; 315/DIG. 7; 315/276; 315/307; 315/71; 315/56

[58] Field of Search ..... 315/324, 312, 315/276, 246, DIG. 4, DIG. 7, DIG. 2, 307, 56, 71

[56] References Cited

U.S. PATENT DOCUMENTS

| | | | |
|---|---|---|---|
| 2,139,815 | 12/1938 | Fodor | 315/246 |
| 3,235,771 | 2/1966 | Schwartz | 315/312 |
| 3,801,865 | 4/1974 | Roberts | 315/276 |
| 4,613,795 | 9/1986 | Itani et al. | 315/DIG. 7 |
| 5,491,387 | 2/1996 | Saito | 315/DIG. 7 |

*Primary Examiner*—Michael B Shingleton
*Attorney, Agent, or Firm*—Jim Zegeer

[57] ABSTRACT

A low-voltage landscape lighting system having a stepdown transformer having a predetermined power rating and primary and secondary windings with said primary windings. The primary winding is adapted for connection to an AC supply source and the secondary winding being adapted for connection to a low-voltage outdoor power distribution cable and a plurality of lamp fixtures electrically connected to the power distribution cable. A number of low-voltage, non-thermionic, ballast-free fluorescent light sub-systems are connected to the distribution cables. Each has a fluorescent discharge lamp with electrodes spaced in a gaseous medium, a light transmissive envelope confining a gaseous discharge medium at a predetermined pressure between the electrodes. A power supply including a rectifier connected to the power distribution cable and constituting a direct current source is connected to a solid state switch device. The switch device is operated to generate a substantially square wave alternating current wave at the lamp electrodes so that the voltage supplied to the electrodes reverses polarity more rapidly than the pattern of electron and ion density in the tube can shift and electrons throughout the length of the tube are continually accelerated and will, through several cycles of the square wave create ions throughout the tube's volume, in steady state operation.

12 Claims, 4 Drawing Sheets

LOW-VOLTAGE NON-THERMIONIC BALLAST-FREE ENERGY-EFFICIENT GAS-DISCHARGE LANDSCAPE LIGHTING SYSTEM AND METHOD USING HIGH-FREQUENCY SQUARE WAVE AC DRIVER CIRCUITS

This application is related to U.S. application Serial No. 08/942,670 filed Oct. 2, 1997 entitled LOW-VOLTAGE NON-THERMIONIC BALLAST-FREE FLUORESCENT LIGHT SYSTEM AND METHOD which in turn was the subject of provisional application Ser. No. 60/053,796 filed Jul. 25, 1997 which are incorporated hereby reference. This application is also a continuation-in-part of my application Ser. No. 08/964,824 for LOW VOLTAGE NON-THERMIONIC BALLAST-FREE ENERGY-EFFICIENT LIGHT-PRODUCING GAS DISCHARGE SYSTEM AND METHOD filed Nov. 5, 1997 and incorporated herein by reference.

Reference is also made to my application Ser. No. 08/915,696 filed Aug. 21, 1997 entitled LOW-VOLTAGE HIGH-EFFICIENCY FLUORESCENT SIGNAGE, PARTICULARLY EXIT SIGN and incorporated herein by reference.

BACKGROUND AND BRIEF DESCRIPTION OF THE INVENTION

In a typical low-voltage landscape/patio/walkway etc. (hereafter "landscape") lighting system, a step-down transformer is used to drop conventional line voltage (110–120 V AC) to a safe low voltage of about 12 volts AC. Low-voltage (about 12 volts in one commercial brand), low-wattage (in one typical commercial brand, bulbs are selectable from about 4, 7 and 11 watts) incandescent lamps in lamp fixtures are connected by a distribution cable to the low-voltage winding side of the stepdown transformer. The lamp fixtures can be of various styles—from accent lights to globe lighted, floodlights to tier lights. The step down transformers are usually contained in power packs of a predetermined wattage (44, 88, 121, 200, 300 and 500 watts being typical of one commercial brand of low-voltage landscape lighting systems) so that the total bulb wattage can not exceed the wattage rating of the power pack. For example for a stepdown transformer power pack rated at 88 watts, eight 11-watt bulb fixtures can be used, or twenty two four watt bulbs in fixtures could be safely used. Alternatively, up to twelve 7-watt bulbs and fixtures could be used.

THE PRESENT INVENTION

The object of the present invention is to provide voltage landscape lighting systems and methods, more particularly, to provide significantly more efficient low-voltage, low-current landscape lighting system which is more efficient, less expensive, substantially free of RF emissions and which can use conventional gas discharge lamps (fluorescent tubes of various shapes and sizes, high-intensity fluorescent lamps). Since the fluorescent lights of the present invention are significantly lower in power consumption (for example two watts per fixture) and produce significantly more light than incandescent bulbs that it replaces, many more fluorescent fixtures incorporating the invention can be connected to a stepdown transformer power pack of a given size.

According to the invention, each fluorescent fixture incorporates a rectifier, a low-voltage square wave power supply driver circuit coupled to the low AC voltage of the stepdown transformer by a rectifier. The square wave power supply incorporates a solid state switch means which is operated to generate a substantially square wave alternating current wave at the fluorescent lamp or tube electrodes such that the voltage supplied to the electrodes reverses polarity more rapidly than the pattern of electron and ion density in the tube can shift so that electrons throughout the length of the device are continually accelerated and will, through several cycles of the applied square wave, create free electrons and ions throughout the tube's volume, in steady state operation and ionize the gas lighting lamp.

According to a preferred embodiment of the present invention, the stepdown transformer of an landscape lighting system is connected to a low cost rectifier provided at each lamp position. A low-voltage alternating current square wave generator is connected to the stepdown transformer output and the AC square wave generator is connected to at least one fluorescent light-producing device with electrodes (which may be conventional filaments or not) immersed in a gaseous discharge medium non-thermionically (no heater or filament currents) driven with a low-voltage, high-frequency alternating current square wave voltage from the generator. In one preferred embodiment of the present invention, the driver circuit includes a small switching transformer and a solid state switching device which alternately switches the transformer primary across the direct current supply constituted by the rectifier output. In the preferred embodiment, the oscillating frequency is set in the range from about 75 kHz through about 4 MHz. Since there are no high voltages in the driver circuit, safe operation is assured.

Illumination or luminosity levels or dimming can be achieved by varying the voltage (or energy level) from the direct current supply. In the preferred embodiment, care is taken to assure that there are no spike voltages due to inductive kick and the like. Since the gas discharge lamps or devices are non-thermionically driven, the luminous efficiency is significantly improved. Moreover, at the high frequency range, power supply components can be smaller.

A salient difference between the system of the present invention and traditional incandescent landscape lamp systems is the marked reduction in current, power consumption and heat accompanied by a significant increase in light output, which is in turn the reason why their efficiency of conversion of electricity to light is so high. Some of the heat (power) reduction is, of course, recognizable as resulting from the absence of direct heating of the filaments in each end of the tube by applied voltages. Some is also explained in terms of energy transfer in the high-field region which occurs near the momentary cathode. However, fluorescent lamps in the system of the present invention are much cooler throughout their length, including areas that are at great distances from the filaments whose heating could not possibly be explained by conduction, radiation, or diffusive heat transfer through the low-pressure gas filling the tube. (The overall applied voltage is not large enough to suggest that local regions of high field exit in tubes driven by the present invention.)

Cooling along the length of the tube is believed to be explainable in terms of energy transferred to electrons and ions by the applied electric field. In the present invention, the square wave voltage applied to the tube reverses so frequently that positive ions in the discharge can build up little kinetic energy during a half-cycle of the applied voltage. In conventional fluorescent lighting systems, larger amounts of energy can be acquired by ions in one-half cycle. This kinetic energy contributes nothing to light output, but in conventional systems is rapidly transferred to the neutral gas molecules and thence to the walls of the tube.

A major source of energy loss in conventional fluorescent tubes is caused by need to almost completely reconstitute ionization in the tube, at the beginning of each half-cycle. This requires not only energy to ionize electrically neutral gas molecules, but additional energy representing losses when electrons collide with neutral gas molecules and thereby increase their motional energy without ionizing the molecules. The non-thermionic, ballast-free, low-voltage system of this invention also works on other gases different from mercury vapor, like neon, neon/helium, sodium vapor, neon/argon and others as well as plasma displays.

The fact that the system is non-thermionic and ballast-free eliminates the danger and cause of electrical fires caused by overheated ballast driven systems. The low voltage eliminates the danger of electrical shock to humans, and because it is low voltage is essentially non-lethal to humans and thus safer.

DESCRIPTION OF THE DRAWINGS

The above and other objects, advantages and features of the invention will become more apparent when considered with the following specification and accompanying drawings wherein.

DETAILED DESCRIPTION OF THE INVENTION

Figure 1:
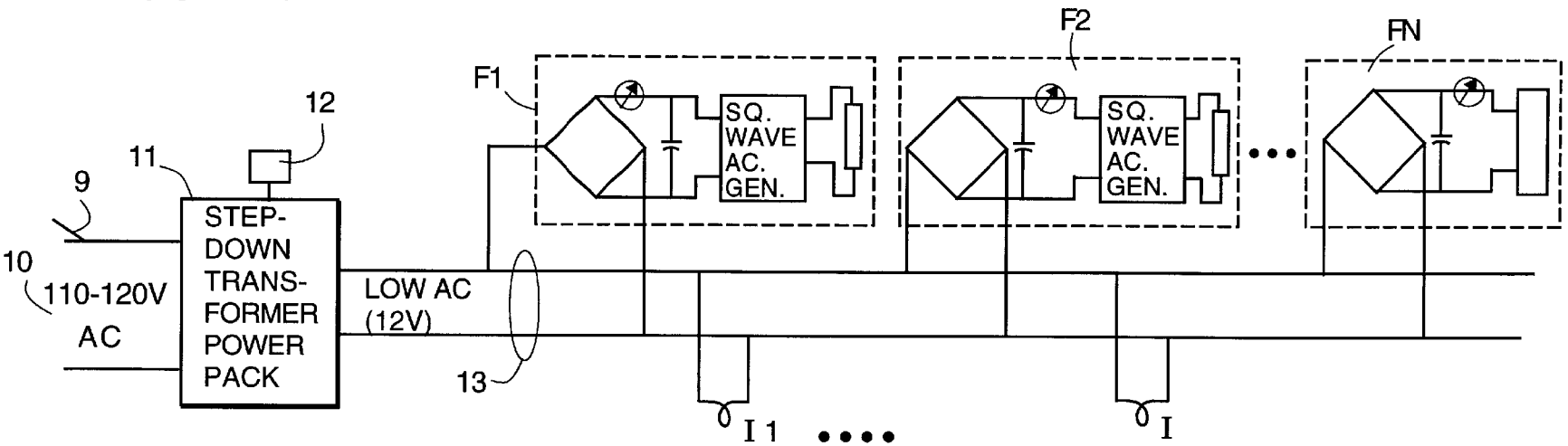
FIG. 1 is a general block diagram of the landscape lighting system incorporating the invention.

The present invention is based on the discovery, disclosed in my above identified applications, that using a rapidly repetitive low-voltage square wave alternating voltage, ionization will take place in gas discharge tubes at lower voltages and power. Since the half-cycle period of the square wave alternating voltage power according to the invention is very short (of the order of 5 microseconds for 100 kHz), there is very little opportunity for decay of the plasma between half-cycles. At start-up, ambient free electrons in the gas increase in energy in a half-cycle more than they lose energy due to collision processes. According to the invention, during one half-cycle, an electron will move in a roughly constant electric field. During each interval between collisions with neutral atoms, or ions, its kinetic energy will increase if its previous collision left it traveling with a component of velocity in the direction of the acceleration produced by the electric field. It will decrease if its previous collision left it moving without a component of velocity opposed to the field's acceleration. According to the invention, the square wave alternating supply voltage serves principally to raise the effective electron energy (or temperature). The current flowing consists of electrons flowing to the instantaneous anode and positive ions flowing to the instantaneous cathode where they recombine with electrons and are released as neutral atoms. Total gas pressure in the tube is sufficient to make the mean free path considerably less than the tube diameter and much less than its length. Most electrons and ions separate and recombine, in a small fraction of the overall length of the tube, rather than flowing as continuous streams along its axis.

If the lamp system of the present invention starts at voltage levels far below that usually associated with plasma "breakdown",why does an equally low voltage applied constantly across a single tube not result in the same glowing plasma? This can be explained in terms of the natural tendency of particles of a plasma subject to a static external field to move so as to create a space charge pattern and field that counteracts the applied field. The result of applying a voltage between two electrodes is to induce positive charge on the positive electrode and negative charge on the negative electrode, the absolute amount of charge depending on course on the capacitance between the two.

If free electrons and ions fill, the space between these electrodes, the electrons are pulled toward the anode, and the positive ions toward the cathode, until in the space between there is no longer a field and therefore no means to cause further movement of the particles; a voltage drop, that is, region of high field, will exist very close to each of the two electrodes. The electrons (and ions) in the main part of the tube will not be further affected by the field; when electrons reach the high field region near the anode, they will probably be accelerated to half the applied voltage within less than one mean free path of the anode's surface and hence will be unlikely to produce ionization.

In the gas discharge light-producing system of this invention, the applied square wave voltage is alternated rapidly enough that the charged particles cannot move enough to accumulate near cathode and anode during a half-cycle of the applied voltage. Thus, the field remains almost continuously active in accelerating electrons within the main body of the tube.

Figure 2:
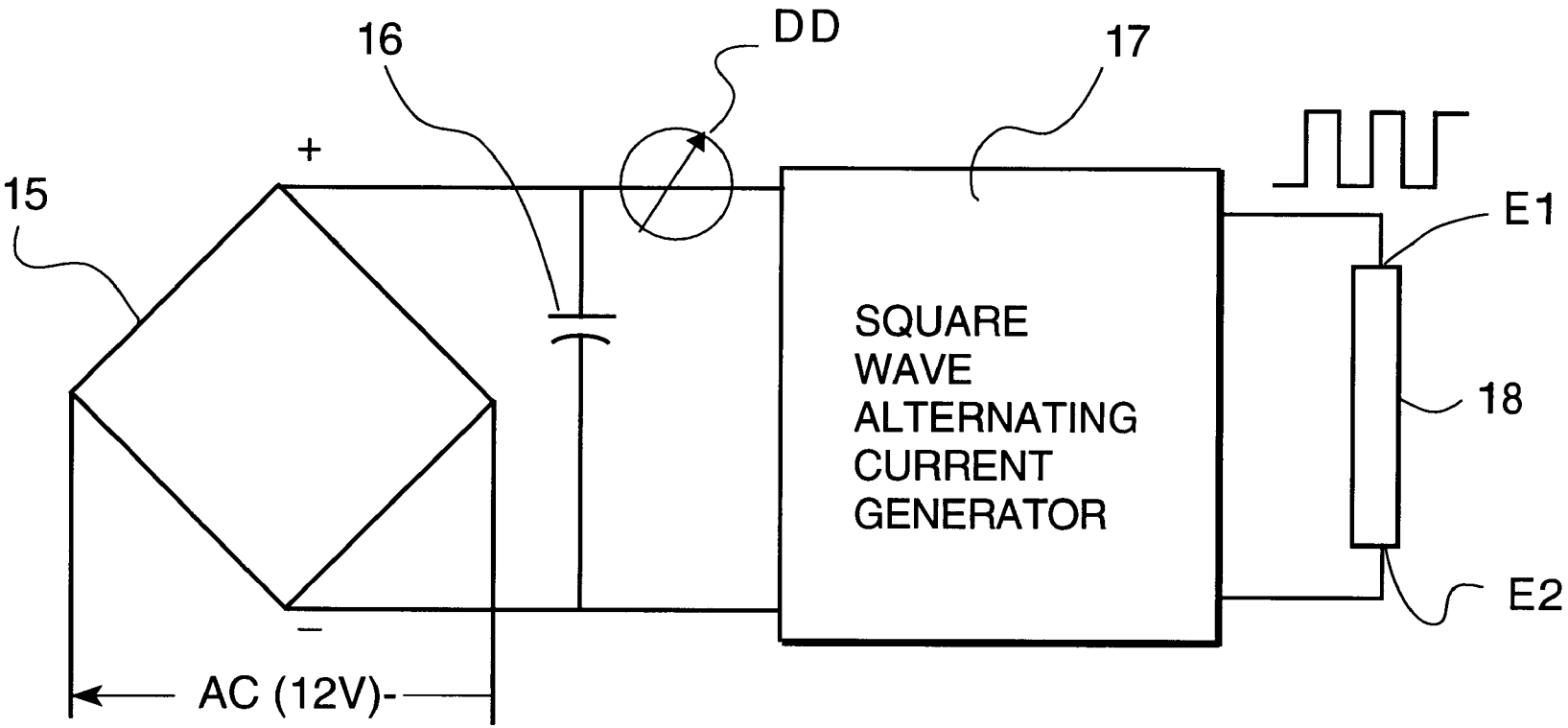
FIG. 2 is a general block diagram of a fluorescent driving system enclosed in dash lines in FIG. 1 incorporating a preferred embodiment of the invention.

Referring now to FIG. 1, 110–120 volt AC line voltage 10 is supplied to stepdown transformer power pack 11 (which may be controlled by a light sensor 12, or at a switch 9 as is conventional) which can include one or more trippable circuit breakers (not shown) and output a low (12 volts for example) on a distribution cable 13. A plurality of fluorescent light fixtures F-1, F-2, . . . F-N are connected across distribution cable 13. Each fluorescent light fixture F-1, F-2, . . . F-N includes a rectifier 15 (FIG. 2), which preferably bridge rectifier. The output of the rectifier 15 is filtered by filter capacitor 16 and applied through optional dimmer control device DD so that each fluorescent fixture is independently dimmable. Since the currents in this invention are very low level, a simple rheostat can be used. This low direct current (DC) voltage is applied to square wave alternating current (AC) generator 17 which operates at a frequency range of 75 kHz to about 4 MHz and outputs a low voltage (in this case under 12 volts) alternating current square wave which is applied directly to the electrodes E1 and E2 of fluorescent tube 18. Fluorescent tube 18 can take many shapes—straight, U-shape, etc. The DC voltage is applied to square wave inventor circuit which converts the DC voltage to a low-voltage AC square wave voltage having a high-frequency (between about 75 kHz and about 4 MHz) which is applied to electrodes. The current is very low so in comparison with light output equivalent to a conventional incandescent landscape lamps as well as conventional 60 Hz, thermionically operated fluorescent tube or lamp, the luminous efficiency is significantly improved. Moreover, the fluorescent lamp or tube can be straight, folded or looped as indicated above. A rheostat DD can be used to adjust or vary the voltage or energy level from the source to fluorescent lamp device and thereby dim or vary the level of luminosity from the lamp. Since the system does not depend on a large ignition voltage level, the luminosity can be varied from low to high and back to low. In contrast, most conventional dimming circuits for fluorescent lamps require starting with a relatively high luminosity or level of illumination and then reducing the level to a desired point.

In this embodiment of the invention, alternating current (120 VAC for example) is applied to terminals of full wave bridge rectifier 15 which provides DC voltage which is filtered by an electrolytic capacitor 16. Other sources of direct current voltage, such as batteries, solar cells, etc., may be used to provide operating energy.

Figure 3:
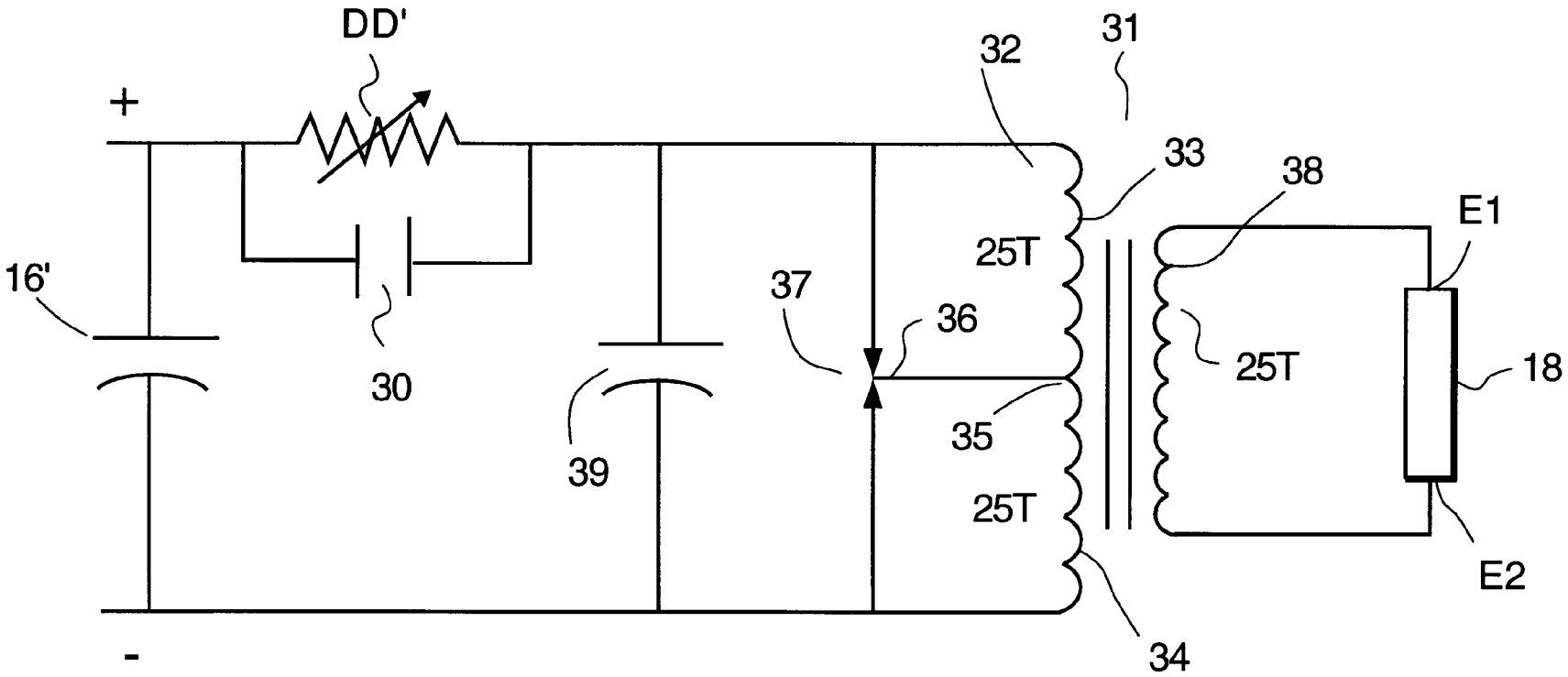
FIG. 3 is a circuit diagram of a square wave alternating current generator incorporating the invention.

FIG. 3 illustrates a low-voltage square wave inventor circuit requiring a minimum of five components (the electrolytic filter capacitor 16 is deemed to be a part of the DC power source or supply). DC power is supplied to the low-voltage square wave inventor driver circuit via dimmer resistor DD and filter capacitor 30. This driver circuit includes an oscillation transformer 31 having a center tapped primary winding 32 having primary winding 33 and 34 with the center tap 35 connected to gate electrode 36 of oscillating diode transistor 37. The opposing ends of oscillating diode transistor 37 are connected to the upper and lower ends of the primary windings 33 and 34. As shown, in transformer 31, primary windings 33 and 34 and secondary winding 38 have about 25 turns each. A capacitor 39 shunts the oscillating transistor/diode 37. The exemplary circuit components are as follow:

| | |
|---|---|
| Fluorescent tube | FT6 |
| Resistor DD' | 1500 Ohms |
| Capacitor 16' | 47UF 10V Electrolytic |
| Transistor diode 37 | 5609/6BC/ECB |
| Capacitor 30 | 2A562K |
| Capacitor 39 | 2A22K |

The output to the fluorescent tube is about 1.4 volts RMS at 3.9 MHz open circuit and 1.7 MHz, square wave at the tube. Thus, the system has no ballast transformer, no thermionic heating of filaments, no starter circuit, and produces light in a more energy-efficient way.

Figure 4:
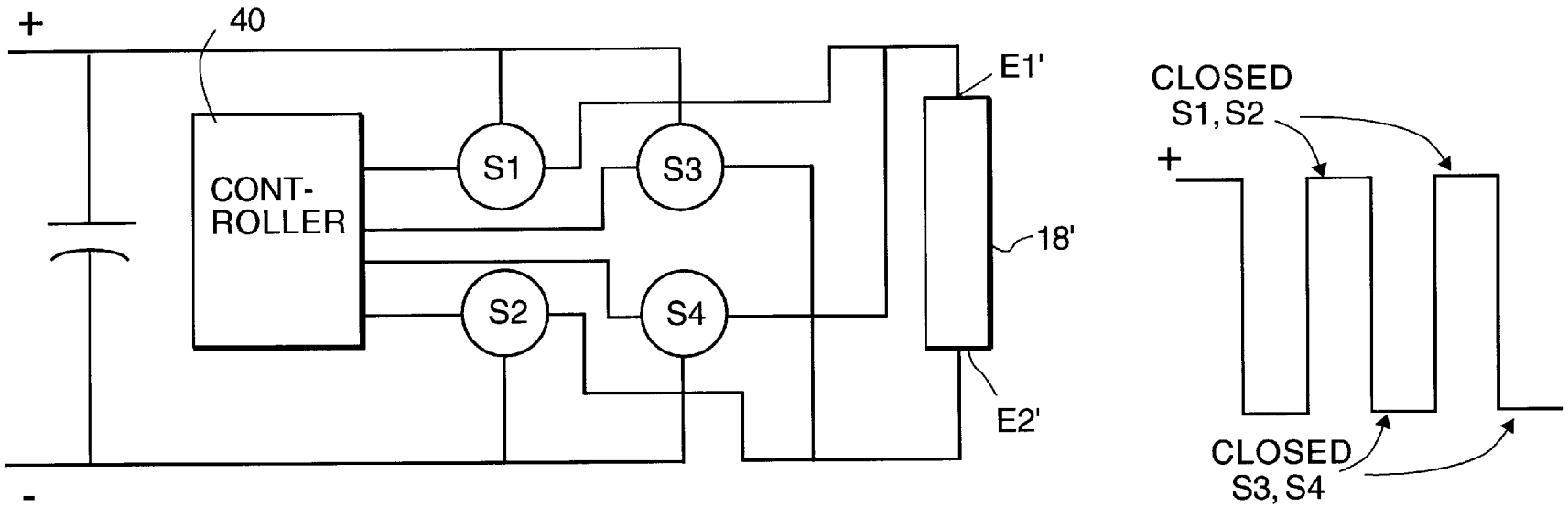
FIG. 4 is a generalized circuit diagram of a square wave alternating current generator incorporating the invention.

FIG. 4 diagrammatically illustrates a transformer-less square wave inventor circuit. Here, the positive (+) and negative (−) terminals of a direct current source are alternately connected to opposing electrodes of the fluorescent lamp(s). In this case, when switches S1 and S2 are closed simultaneously or at the same time (preferably by the same signal from controller 40, the positive terminal (+) is connected to electrode E-1 and the negative terminal (−) is connected directly to electrode E-2. When the switches S3 and S4 are simultaneously closed (and switches S1 and S2 are open) by controller 40, the positive terminal (+) is connected directly to lamp electrode E-2 and the negative terminal (−) is connected to fluorescent lamp electrode E-1. Controller 40 can operate the switches in the range of about 75 kHz to about 3.9 MHz and preferably operates the switches to cause the square wave applied to lamp electrodes E-1 and E-2 to be at a frequency of about 100 kHz.

In this invention, the magnitude of the alternating voltage at the electrodes is of small significance in initiating the discharge reaction, allowing the capability to start the production of visible light at a low or high intensity—since the light generated is in direct proportion to the total energy input. (There is no need for a large "starting strike" voltage to ionize the gas.)

While preferred embodiments of the invention have been described and illustrated, it will be appreciated that other embodiments, adaptations and modifications of the invention will be readily apparent to those skilled in the art.

What is claimed is:

1. In a low-voltage landscape lighting system having a stepdown transformer, said stepdown transformer having a predetermined power rating and primary and secondary windings with said primary winding being adapted for connection to an AC supply source and said secondary winding being adapted for connection to a low-voltage outdoor power distribution cable and a plurality of lamp fixtures electrically connected to said power distribution cable, the improvement comprising:

each lamp fixture including a low-voltage, non-thermionic, gas discharge light-producing sub-system, each sub-system comprising:

at least one gas discharge lamp device with lamp electrodes spaced in a gaseous medium, a light transmissive envelope confining said gaseous discharge medium at a predetermined pressure between said lamp electrodes, and a high-frequency alternating current square wave voltage driver circuit, said high-frequency alternating current square wave voltage driver circuit including a rectifier connected to said power distribution cable said rectifier having output terminals constituting a direct current source, a solid state switch circuit connected between said direct current source and said lamp electrodes and means connecting said switch circuit to said lamp electrodes, said switch circuit being operated to generate a substantially square wave alternating current voltage at said lamp electrodes to start and operate said gas discharge lamp device such that the square wave voltage applied to said lamp electrodes reverses polarity more rapidly than the pattern of electron and ion density in the gas can shift and electrons throughout the space between said lamp electrodes are continually accelerated and will, through several cycles of said square wave alternating current voltage create ions in the envelope volume, in steady state operation.

2. The landscape lighting system defined in claim 1 wherein said low-voltage, high-frequency square wave voltage is in the frequency range of about 75 kHz to about 4 MHz.

3. The landscape lighting system defined in claim 1 wherein said low-voltage, high-frequency square wave voltage source includes means to adjust the amplitude of voltage at said lamp electrodes to vary the intensity of light produced by said lamp device.

4. The landscape lighting system defined in claim 1 wherein said low voltage is under 12 volts.

5. The landscape lighting system defined in claim 1 wherein said low voltage is under 12 volts and has a frequency in the range of about 75 kHz to about 3.5 MHz.

6. The landscape lighting system defined in claim 1 wherein said voltage is about 2 volts and said frequency is about 3.5 MHz.

7. The landscape lighting system defined in claim 1 wherein said gas discharge lamp device has a UV activated fluorescent coating on said light transmission envelope.

8. A method of driving a low-voltage landscape lighting system having a stepdown transformer, said stepdown transformer having a predetermined power rating and primary and secondary windings with said primary winding being adapted for connection to an AC supply source and said secondary winding being adapted for connection to a low-voltage outdoor power distribution cable and a plurality of lamp fixtures electrically connected to said power distribution cable, said method comprising:

providing a number of low-voltage, non-thermionic, gas discharge light-producing sub-systems, each sub-system comprising at least one gas discharge lamp device with lamp electrodes spaced in a gaseous medium, a light transmissive envelope confining the gaseous discharge medium at a predetermined pressure between said spaced lamp electrodes and a fluorescent coating on said light transmission envelope, and providing a power supply, said power supply including a rectifier connected to said power distribution cable and constituting a direct current source, a solid state switch circuit connected between said source of direct current and said lamp electrodes and means connecting said solid state switch circuit to said lamp electrodes, said solid state switch circuit being operated to generate a high-frequency substantially square wave alternating current voltage at said lamp electrodes and applying said high frequency substantially square wave alternating current voltage to said lamp electrodes to start and operate said lamp such that the square wave voltage reverses polarity more rapidly than the pattern of electron and ion density in the space between said spaced electrodes can shift and electrons throughout the length of the tube are continually accelerated and will, through several cycles of said high-frequency square wave alternating voltage create ions throughout the tube's volume, in steady state operation.

9. The method defined in claim 8 wherein said low-voltage, high-frequency square wave voltage is under 12 volts and in the frequency range of about 75 kHz to about 4 MHz.

10. The method defined in claim 8 including the step of adjusting the amplitude of said low-voltage, high-frequency square wave voltage to adjust the intensity of light produced by said lamp device.

11. The method defined in claim 8 wherein said voltage is about 2 volts and said frequency is about 3.5 MHz.

12. A landscape lighting system having a plurality of fluorescent lamp fixtures, each fluorescent lamp fixture including a low-voltage, non-thermionic, gas discharge light-producing sub-system, each sub-system comprising:

a fluorescent discharge lamp device with lamp electrodes spaced in a gaseous medium, and a source of DC power, a low-voltage, high-frequency alternating current square wave voltage driver circuit, said low-voltage, high-frequency alternating current square wave voltage driver circuit connected to said source of DC power, said low-voltage, high-frequency square wave driver circuit being operated to generate a substantially square wave alternating current voltage is at a frequency in the range of about 75 kHz to about 3.5 MHz and applied directly to said lamp electrodes to start and operate said gas discharge lamp device such that the square wave voltage applied to said lamp electrodes reverses polarity more rapidly than the pattern of electron and ion density in the gas can shift and electrons throughout the space between said lamp electrodes are continually accelerated and will, through several cycles of said square wave alternating current voltage create ions in the envelope volume, in steady state operation.

* * * * *